US008491447B1

(12) United States Patent
Koranic

(10) Patent No.: US 8,491,447 B1
(45) Date of Patent: Jul. 23, 2013

(54) HAND EXERCISING GLOVE DEVICE

(76) Inventor: Andrew T. Koranic, Reservoir (AU)

( * ) Notice: Subject to any disclaimer, the term of this patent is extended or adjusted under 35 U.S.C. 154(b) by 303 days.

(21) Appl. No.: 13/072,927

(22) Filed: Mar. 28, 2011

(51) Int. Cl.
*A63B 21/00* (2006.01)

(52) U.S. Cl.
USPC ..... 482/44; 482/45

(58) Field of Classification Search
USPC . 482/44, 121; 128/878, 879; 602/20; 601/21; 2/162, 161.1, 159
See application file for complete search history.

(56) References Cited

U.S. PATENT DOCUMENTS 1,126,938 A * 2/1915 Barrett ..... 84/468
3,944,220 A 3/1976 Fasano
4,830,360 A 5/1989 Carr, Jr.
5,373,585 A 12/1994 Wiggins
5,538,488 A * 7/1996 Villepigue ..... 482/47
5,697,103 A * 12/1997 Wiggins ..... 2/159
7,163,308 B2 * 1/2007 Ferrari et al. ..... 362/103
7,210,172 B2 * 5/2007 Adams, Jr. ..... 2/163
7,892,194 B2 * 2/2011 Farrell et al. ..... 602/21
8,209,775 B2 * 7/2012 Makis ..... 2/162

* cited by examiner

*Primary Examiner* — Jerome w Donnelly

(57) ABSTRACT

The hand exercising glove device is a glove having a back side spaced apart from a palm side, a quintet of digits extended from the back side and the palm side, each digit comprising an open end disposed at an existing fingertip of a user, a pad disposed within the back side atop each base knuckle of a user, a wrist section extended from the back side and the palm side, an adjustable retaining strap encircling the wrist section, a digit reinforcement encircling each digit back side adjacent to each open end, a back side reinforcement embedded within the back side adjacent to the wrist section, a hook disposed on each digit reinforcement, a plurality of spaced apart hooks disposed on the back side reinforcement, and an elastic tensioned strand connecting each back side reinforcement hook to one of each of the digit hooks, the tensioned strands disposed over four of the pads.

11 Claims, 3 Drawing Sheets

HAND EXERCISING GLOVE DEVICE

CROSS-REFERENCE TO RELATED APPLICATIONS

Not Applicable

FEDERALLY SPONSORED RESEARCH OR DEVELOPMENT

Not Applicable

INCORPORATION BY REFERENCE OF MATERIAL SUBMITTED ON A COMPACT DISK

Not Applicable

BACKGROUND OF THE INVENTION

Various types of hand exercising glove devices are known in the prior art. However, what is needed is a hand exercising glove device including multiple rubber tensioned strands attached by hooks at both ends of each finger as well as the thumb and including a fastener strap disposed around the wrist, along with weight adding capability to strenghten hands and arms and shoulders. The present device exercises a user's hand, arm, and shoulder while allowing natural movement of the fingers and the thumb for increased strength and to aid in prevention of repetitive strain injury and provide for greater endurance.

FIELD OF THE INVENTION

The present invention relates to a hand exercising glove device, and more particularly, to a hand exercising glove device including multiple rubber tensioned strands attached by hooks proximal to the ends of each finger and thumb and also to back side reinforcement proximal to the wrist, the device also including a fastener strap for the wrist and removable wrist weights.

SUMMARY OF THE INVENTION

The general purpose of the present hand exercising glove device, described subsequently in greater detail, is to provide a hand exercising glove device which has many novel features that result in a hand exercising glove device which is not anticipated, rendered obvious, suggested, or even implied by prior art, either alone or in combination thereof.

The present hand exercising glove device includes a plurality of rubber tensioned strands attached by hooks at the digit reinforcements at the open ends of each finger and to an embedded back side reinforcement disposed on the back side adjacent to the wrist. The reinforcements importantly prevent excessive glove movement so that the elastic tensioned strands supply the most localized and effective resistance possible. The pads importantly prevent knuckle aggrivation and chance of abrasion.

Further, the elastic tensioned strands may be pretensioned so that merely wearing the glove supplies resistance to a straight, stationary hand. The device exercises the hands via resistance against finger and hand flexion while allowing natural movement of the fingers and the thumb for conditioning to prevent repetitive strain injury. A detachable or affixed wrist weight may be provided in a variety of masses. A user can thereby also strengthen arm and shoulder. Padding is provided over each knuckle to prevent the strands from rubbing against each knuckle. Tension is applied to the fingers and the thumb to increase strength, endurance, speed, coordination, and flexibility while playing a musical instrument or involved in other activities. Each glove may be made from a pliable elasticized material that is comfortable to wear and conforms to the hand. The fastener strap is adjustable.

Thus has been broadly outlined the more important features of the present hand exercising glove device so that the detailed description thereof that follows may be better understood and in order that the present contribution to the art may be better appreciated.

An object of the hand exercising glove device is to provide for exercising a hand during various activities.

An object of the hand exercising glove device is to provide for exercising an arm and shoulder simultaneously with exercising a hand.

Another object of the hand exercising glove device is to prevent hand aggravation during use.

And, an object of the hand exercising glove device is to provide varied mass additions for exercising an arm and shoulder.

Still another object of the hand exercising glove device is to leave finder tips open to use.

Objects of the present hand exercising glove device, along with various novel features that characterize the invention are particularly pointed out in the claims forming a part of this disclosure. For better understanding of the hand exercising glove device, its operating advantages and specific objects attained by its uses, refer to the accompanying drawings and description.

DETAILED DESCRIPTION OF THE DRAWINGS

With reference now to the drawings, and in particular FIGS. 1 through 5 thereof, example of the hand exercising glove device employing the principles and concepts of the present hand exercising glove device and generally designated by the reference number 10 will be described.

Figure 1:
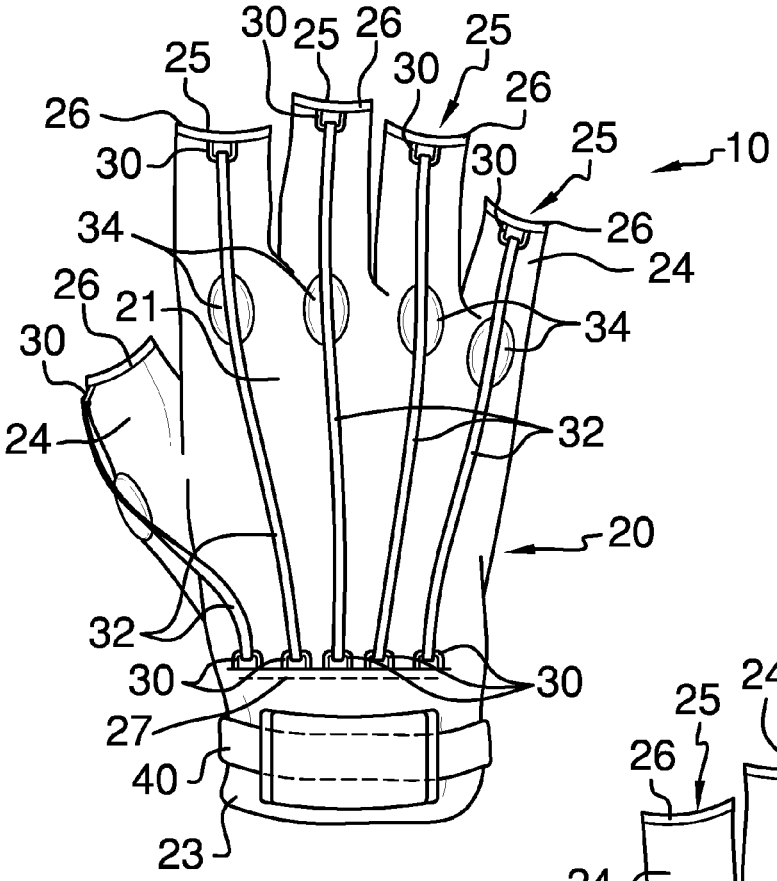
FIG. 1 is a back plan view.

Referring to FIG. 1, the device 10 partially comprises the pliable elasticized glove 20 having a back side 21.

Figure 2:
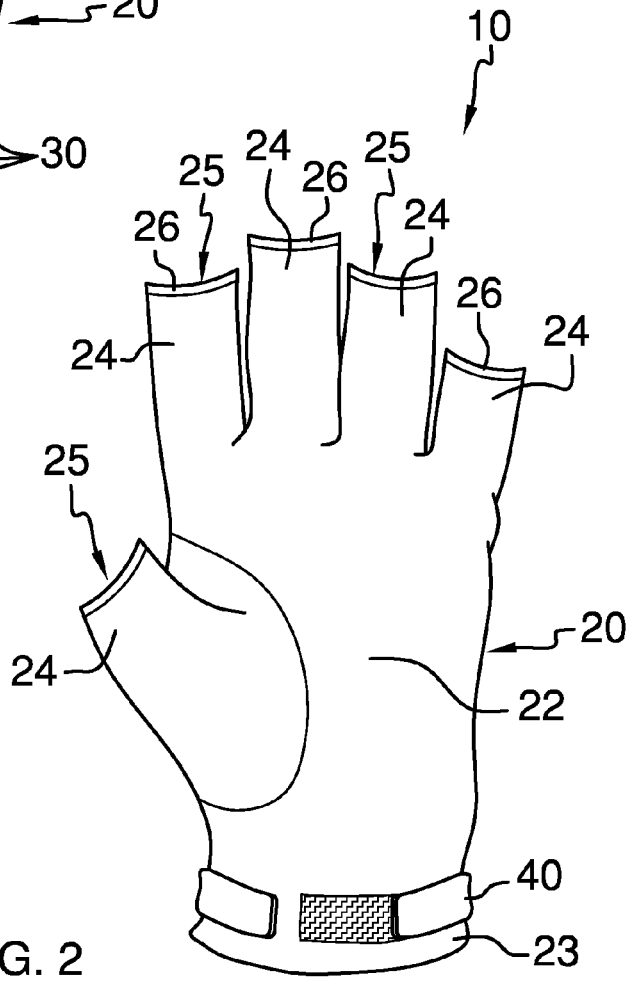
FIG. 2 is a palm plan view.

Referring to FIG. 2, the glove 20 further comprises a palm side 22. A quintet of digits 24 extend from the back side 21 and the palm side 22. Each digit 24 comprises an open end 25 disposed at an existing fingertip 12 of a user.

Figure 3:
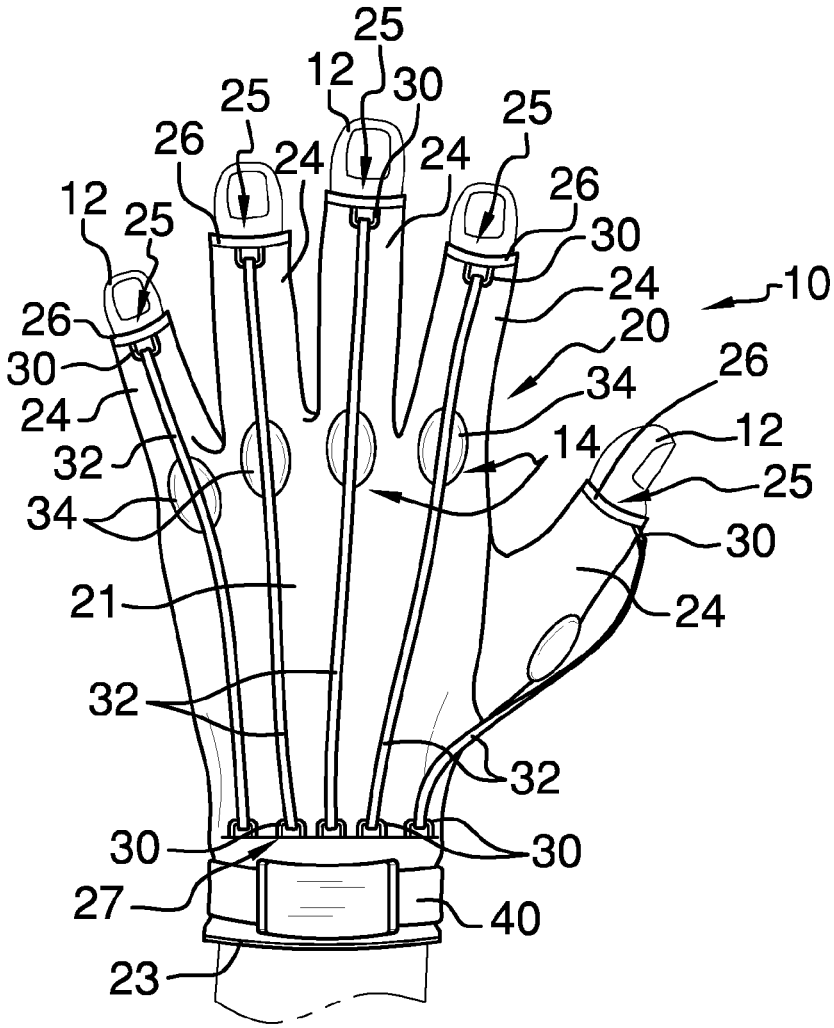
FIG. 3 is an in-use back plan view.

Referring to FIG. 3, a pad 34 is disposed within the back side 21 atop each base knuckle 14 of a user's first four fingers. A wrist section 23 extends from the back side 21 and the palm side 22. The wrist section 23 selectively extends over a wrist of the user.

Referring to FIG. 2, the adjustable retaining strap 40 encircles the wrist section 23.

Referring again to FIG. 3, a digit reinforcement 26 encircles each digit 24 back side 21. Each digit reinforcement 26 is immediately adjacent to each open end 25. A back side reinforcement 27 is embedded within the back side 21 adjacent to the wrist section 23. A hook 30 is disposed on each digit reinforcement 26. A plurality of spaced apart hooks 30 is disposed on the back side reinforcement 27. An elastic tensioned strand 32 connects each back side reinforcement 27 hook 30 to one of each of the digit 24 hooks 30.

Figure 4:
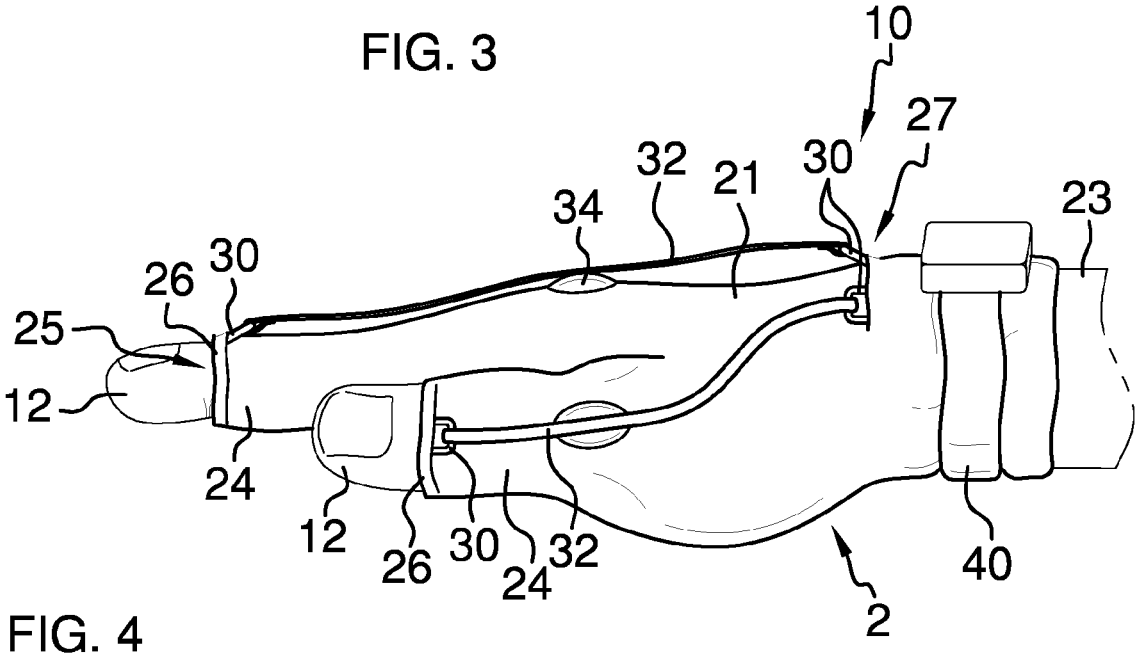
FIG. 4 is an in-use side elevation view, in a non-tensioned position.

Referring to FIG. 4, the elastic tensioned strands 32 may be relaxed in the straight hand position. The elastic tensioned strands 32 may also be pre-tensioned to provide resistance that is continually pulling back and upward on the fingers of the user.

Figure 5:
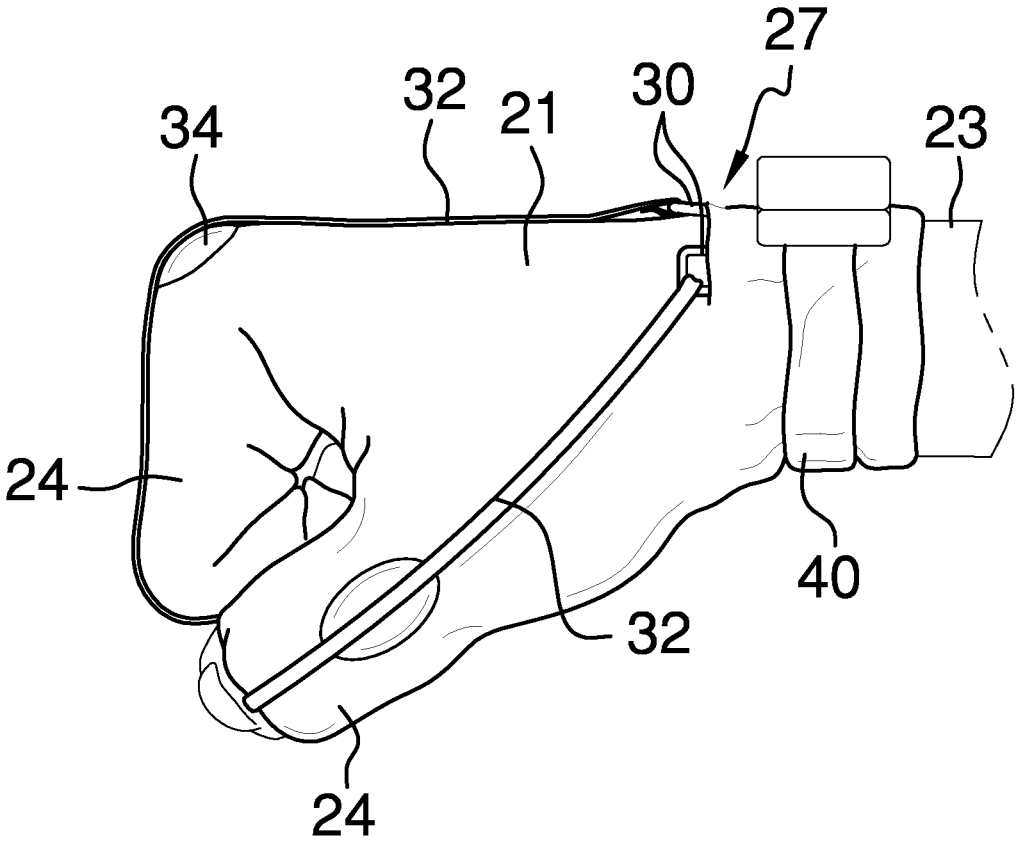
FIG. 5 is an in-use side elevation view, the hand in a tensioned position.

Referring to FIG. 5, fist closure provides the greatest resistance from the elastic tensioned strands 32, thereby resisting hand flexion and providing for conditioning a user's hands through various activities. The weight strap 42 provides arm and shoulder strengthening by adding mass to a user's wrist. The reinforcements prevent glove 20 distortion so that the elastic tensioned strands 32 are most effective.

Directional terms such as "front", "back", "in", "out", "downward", "upper", "lower", and the like may have been used in the description. These terms are applicable to the embodiments shown and described in conjunction with the drawings. These terms are merely used for the purpose of description in connection with the drawings and do not necessarily apply to the position in which the four wheeled transport and lounging device may be used.

What is claimed is:

1. A hand exercising glove device comprising, in combination:

a glove having a back side spaced apart from a palm side;

a quintet of digits extended from the back side and the palm side, each digit comprising an open end disposed at an existing fingertip of a user;

a pad disposed within the back side atop each base knuckle of a user;

a wrist section extended from the back side and the palm side, the wrist section selectively extended over a wrist of the user;

an adjustable retaining strap encircling the wrist section;

a digit reinforcement encircling each digit back side, each digit reinforcement immediately adjacent to each open end;

a back side reinforcement embedded within the back side adjacent to the wrist section;

a hook disposed on each digit reinforcement;

a plurality of spaced apart hooks disposed on the back side reinforcement;

an elastic tensioned strand connecting each back side reinforcement hook to one of each of the digit hooks, four of the tensioned strands disposed over four of the pads.

2. The device according to claim 1 wherein the tensioned strand is pre-tensioned when fitted on a user's hand.

3. The device according to claim 1 further comprising a weight strap removably encircling the wrist section, the weight strap disposed between the retaining strap and the back side and the palm side.

4. The device according to claim 2 further comprising a weight strap removably encircling the wrist section, the weight strap disposed between the retaining strap and the back side and the palm side.

5. The device according to claim 3 further comprising a plurality of varied mass weight straps.

6. The device according to claim 4 further comprising a plurality of varied mass weight straps.

7. An exercise glove device comprising, in combination:

a pliable elasticized glove having a back side spaced apart from a palm side;

a quintet of digits extended from the back side and the palm side, each digit comprising an open end disposed at an existing fingertip of a user;

a pad disposed within the back side atop each base knuckle of a user;

a wrist section extended from the back side and the palm side, the wrist section selectively extended over a wrist of the user;

an adjustable retaining strap encircling the wrist section;

a digit reinforcement encircling each digit back side, each digit reinforcement immediately adjacent to each open end;

a back side reinforcement within the back side adjacent to the wrist section;

a hook disposed on each digit reinforcement;

a plurality of spaced apart hooks disposed on the back side reinforcement;

an elastic tensioned strand connecting each back side reinforcement hook to one of each of the digit hooks, four of the tensioned strands disposed over four of the pads.

8. The device according to claim 7 wherein the tensioned strand is pre-tensioned when fitted on a user's hand.

9. The device according to claim 7 further comprising a weight strap removably encircling the wrist section, the weight strap disposed between the retaining strap and the back side and the palm side.

10. The device according to claim 8 further comprising a weight strap removably encircling the wrist section, the weight strap disposed between the wrist strap and the back side and the palm side.

11. The device according to claim 9 further comprising a plurality of varied mass weight straps.

* * * * *